US008775058B2

(12) United States Patent
Hauser

(10) Patent No.: US 8,775,058 B2
(45) Date of Patent: Jul. 8, 2014

(54) METHOD FOR THE INJECTOR-INDIVIDUAL ADAPTION OF THE INJECTION TIME OF MOTOR VEHICLES

(75) Inventor: Christian Hauser, Lappersdorf (DE)

(73) Assignee: Continental Automotive GmbH, Hannover (DE)

( * ) Notice: Subject to any disclaimer, the term of this patent is extended or adjusted under 35 U.S.C. 154(b) by 846 days.

(21) Appl. No.: 12/993,841

(22) PCT Filed: Mar. 23, 2009

(86) PCT No.: PCT/EP2009/053374

§ 371 (c)(1),
(2), (4) Date: Nov. 21, 2010

(87) PCT Pub. No.: WO2009/141183

PCT Pub. Date: Nov. 26, 2009

(65) Prior Publication Data

US 2011/0077843 A1 Mar. 31, 2011

(30) Foreign Application Priority Data

May 21, 2008 (DE) ..... 10 2008 024 546

(51) Int. Cl.
*G06F 19/00* (2011.01)
*G06G 7/70* (2006.01)
*F02M 51/00* (2006.01)

(52) U.S. Cl.
USPC ..... 701/115; 123/480

(58) Field of Classification Search
CPC . Y02Y 10/44; F02D 41/2467; F02D 41/0025; F02D 41/2454; F02D 41/2432
USPC ..... 73/35.12, 114.38, 114.43, 114.45, 73/11.51; 123/479, 480, 486, 494, 673; 239/585.1; 701/103, 104, 105, 107, 701/115
See application file for complete search history.

(56) References Cited

U.S. PATENT DOCUMENTS

| | | | | |
|---|---|---|---|---|
| 5,839,420 | A | 11/1998 | Thomas | 123/478 |
| 6,418,913 | B1 * | 7/2002 | Schmidt et al. | 123/480 |
| 6,729,297 | B2 * | 5/2004 | Futonagane et al. | 123/299 |
| 6,904,354 | B2 | 6/2005 | Kuegel et al. | 701/104 |
| 7,139,657 | B2 | 11/2006 | Bouchain et al. | 701/104 |
| 7,305,972 | B2 * | 12/2007 | Kloos et al. | 123/479 |

(Continued)

FOREIGN PATENT DOCUMENTS

| | | | |
|---|---|---|---|
| DE | 10215610 A1 | 10/2002 | F02D 41/38 |
| DE | 10232356 | 1/2004 | F02D 41/30 |

(Continued)

OTHER PUBLICATIONS

International Search Report and Written Opinion for Application No. PCT/EP2009/053374 (12 pages), Jul. 28, 2009.

*Primary Examiner* — John Kwon
*Assistant Examiner* — Sizo Vilakazi
(74) *Attorney, Agent, or Firm* — King & Spalding L.L.P.

(57) ABSTRACT

A method for the injector-individual adaption of the injection time of motor vehicles is based on linking the IIC method and the MFMA method. Before starting to drive, the IIC method is carried out, and while driving MFMA measurements are carried out. The measurement points obtained are used as subsequent measurement points for the IIC function. Thus injector-individual characteristic fields can be determined, in which deviations due to manufacturing and also aging and wear of the components during the service life are considered.

14 Claims, 2 Drawing Sheets

(56) References Cited

U.S. PATENT DOCUMENTS

| | | | | |
|---|---|---|---|---|
| 7,765,054 | B2 | 7/2010 | Jung et al. | 701/105 |
| 7,881,857 | B2 | 2/2011 | Samenfink et al. | 701/105 |
| 8,459,234 | B2 * | 6/2013 | Nakata et al. | 123/480 |
| 8,539,935 | B2 * | 9/2013 | Nakata et al. | 123/480 |
| 2003/0154956 | A1 * | 8/2003 | Eckerle et al. | 123/357 |
| 2009/0056676 | A1 * | 3/2009 | Nakata et al. | 123/478 |
| 2009/0299604 | A1 | 12/2009 | Samenfink et al. | 701/103 |

FOREIGN PATENT DOCUMENTS

| | | | | |
|---|---|---|---|---|
| DE | 10256240 | | 6/2004 | F02D 41/38 |
| DE | 10257686 | A1 | 7/2004 | F02D 41/38 |
| DE | 102005051701 | | 5/2007 | F02D 41/40 |
| DE | 102006027405 | | 12/2007 | F02D 41/20 |
| EP | 1400674 | | 3/2004 | F02D 41/14 |

* cited by examiner

METHOD FOR THE INJECTOR-INDIVIDUAL ADAPTION OF THE INJECTION TIME OF MOTOR VEHICLES

CROSS-REFERENCE TO RELATED APPLICATIONS

This application is a U.S. National Stage Application of International Application No. PCT/EP2009/053374 filed Mar. 23, 2009, which designates the United States of America, and claims priority to German Application No. 10 2008 024 546.1 filed May 21, 2008, the contents of which are hereby incorporated by reference in their entirety.

TECHNICAL FIELD

The present invention relates to a method for the injector-individual adaption of the injection time of motor vehicles.

BACKGROUND

In the internal combustion engines of motor vehicles torque requirements are converted into mass flows. Each mass flow (mf) corresponds to an assigned injection time (ti) as a function of the fuel pressure (fup) (ti characteristic field). The relationship is used for all injectors, meaning that injector-individual differences, caused for example by manufacturing differences or ageing of the components over their entire lifetime, are not taken into consideration. Such differences between the actual mass flow and the required mass flow can cause effects such as making the mass flows too small (absence of injections, uneven running), making them too big (engine overheating) and making emissions worse.

There are currently two known processes which make it possible, at least partly, to adapt the ti characteristic fields of individual injectors.

a) IIC (Injector Individual Correction):

This method in which an individual correction of each injector is carried out was originally developed to increase the number of injectors yielded during production. In such cases, with a large number of injectors the ti characteristic fields are measured with mass flow measuring technology and an average ti characteristic field is calculated. The ti characteristic field deviations of all subsequently measured injectors in relation to the average ti characteristic field are measured for a few measuring points (for example for four measuring points MP1: 300 bar/4 mg, MP2: 700 bar/15 mg, MP3: 1000 bar/3 mg, MP4: 1600 bar/40 mg) and extrapolated on the basis of statistical methods for the entire ti characteristic field. The data is then stored for vehicle operation in corresponding characteristic fields.

With this method the measurement has to be undertaken on an injector test bed because of the measurement means needed. It is not possible to repeat the measurement while the vehicle is being driven. Although this method makes a correction of the ti characteristic field possible over the entire injection range, no correction of the values determined is possible during the lifetime (operating time) of the vehicle. This method is therefore restricted to the period before the vehicle is on the road.

b) MFMA (Minimum Fuel Mass Adaption):

With this MFMA method the deviations of the actual and required fuel mass in the minimum fuel mass range (<3 mg) are determined by means of engine speed changes and constantly adapted during the lifetime (operating life) of the motor vehicle. In such cases small injections are carried out at a cylinder in push phases in which no injections normally take place and the associated fuel mass is calculated based on models from a change in the engine speed (n). The correction values are stored in the characteristic fields for individual injectors for the tested minimum fuel masses.

This method is highly accurate and deviations are corrected during the lifetime. However it is only able to be used in the minimum fuel mass range (fuel masses<3 mg), since otherwise injections are perceived acoustically or as vehicle acceleration. Furthermore an expansion of the fuel mass correction beyond the minimum fuel mass range is not possible since the ti characteristic field has different gradients and corrections for an injector can be both positive and negative.

A correction for the complete ti characteristic field during the overall lifetime of a motor vehicle is thus not possible with the IIC and MFMA methods described above.

SUMMARY

According to various embodiments, a method of the type described above can be created with which an injector-individual adaption of the injection time is possible over the entire lifetime of the motor vehicle in the complete ti characteristic field.

According to an embodiment, a method for injector-individual adaption of the injection time of motor vehicles, may comprise: Creating ti characteristic fields of an injector; Carrying out an adaptation of the ti characteristic fields with the aid of the IIC (Injector Individual Correction) method before the vehicle goes on the road; Storing the adapted ti characteristic fields for driving; Carrying out MFMA (Minimum Fuel Mass Adaption) measurements while the vehicle is on the road and using the corresponding measuring points as retrospective measuring points for the IIC function; Computing from these measurements of deviations in relation to the stored IIC ti characteristic fields for the complete ti characteristic fields and storing the same in the corresponding injector-individual characteristic fields; and Using the injector-individual characteristic fields for determining the injection time.

According to a further embodiment, in the IIC method, the ti characteristic fields can be measured with mass flow measurement technology and an average ti characteristic field is computed. According to a further embodiment, the ti characteristic field deviations of an injector from the average ti characteristic field can be measured at a few measuring points and extrapolated for the entire ti characteristic field. According to a further embodiment, the IIC method can be carried out on the injector test bed. According to a further embodiment, in the MFMA method, associated mass flows can be determined and used as retrospective measurement points for the IIC function. According to a further embodiment, the engine speed changes can be undertaken in the smallest mass flow range. According to a further embodiment, small injections can be carried out in push mode and the associated mass flow is calculated from the change in the engine speed. According to a further embodiment, the MFMA method can be carried out during the entire operating life of the motor vehicle.

BRIEF DESCRIPTION OF THE DRAWINGS

The invention will be explained in detail below with reference to an exemplary embodiment in conjunction with the drawings. The figures show.

DETAILED DESCRIPTION

Figure 1:
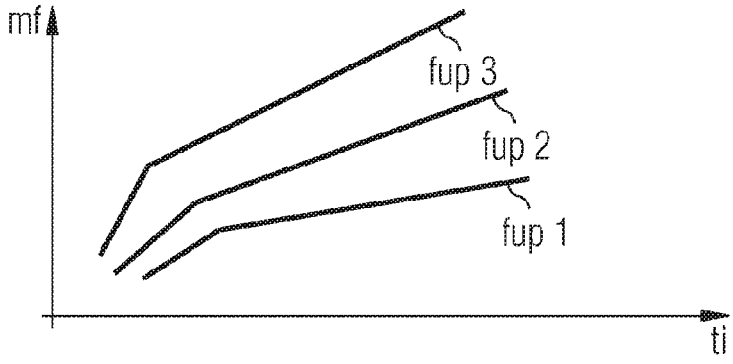
FIG. 1 a diagram showing a typical ti characteristic field for a motor vehicle.

As stated above, according to various embodiments, a method for injector individual adaption of the injection time of motor vehicles, may comprise the following steps:

Setting ti characteristic fields of an injector; Performing an adaption of the ti characteristic fields with the aid of the IIC (Injector Individual Correction) method before starting driving and storing the adapted ti characteristic fields for driving mode;

Carrying out MFMA (Minimum Fuel Mass Adaption) measurements during driving operation and use of the corresponding measurement points as retrospective measurement points for the IIC function;

Calculating from these measurements deviations in relation to the stored IIC ti characteristic fields for the complete ti characteristic fields and storing the same in corresponding injector-individual characteristic fields; and use of the injector-individual characteristic fields for determining the injection time.

Thus a combination of the IIC and MIMA methods (functions) is used in the method according to various embodiments. The advantage is that an injector-individual adaption of the injection time over the entire lifetime in the complete ti characteristic field can be achieved with this method. Deviations of the fuel mass flows during the lifetime are thus determined from a combination of IIC and MFMA methods. In such cases the IIC measurement and calculation of the fuel mass deviations continues to be undertaken over the entire characteristic field before the vehicle is on the road, i.e. especially during manufacturing, in order to compensate for injector-individual deviations while the vehicle is being driven. The MFMA method or the MFMA function is carried out during the operating life of the vehicle, with the MFMA measurements being used as retrospective measuring points for the IIC function. Then, preferably by means of statistical methods, deviations for the complete ti characteristic field are computed and stored for individual injectors in corresponding characteristic fields. These characteristic fields will then be used to determine or to adapt the injection time.

With the method according to various embodiments, while the IIC method is being carried out, the ti characteristic fields are preferably measured with mass flow measurement technology and an average ti characteristic field (at constant fuel pressure fup) is calculated. Preferably the ti characteristic field deviations of an injector from the average ti characteristic field are then measured at a few measuring points and extrapolated for the entire ti characteristic field. This can be carried out with the aid of statistical methods.

The corresponding IIC method will expediently be undertaken on the injector test bed since the necessary measurement means are available here.

In the method according to various embodiments associated mass flows are also determined with the MFMA method preferably by means of changes in engine speed which are used as retrospective measurement points for the IIC function. In this case the engine speed changes are expediently undertaken in the smallest mass flow range in order not to have any adverse effects while the vehicle is being driven. Preferably in such cases small injections are undertaken in push mode, with the associated injection mass flow being calculated from the change in the engine speed.

The MFMA method is expediently carried out over the entire operating life of the motor vehicle so that a permanent injector-individual adaption of the injection time is made possible.

As already mentioned, torque requirements are converted into injection mass flows in internal combustion engines. Each mass flow (mf) corresponds to an assigned injection time (ti) as a function of the fuel pressure (fup). FIG. 1 shows a ti characteristic field in which the dependence of the mass flow mf on the injection time ti is shown for different fuel pressures fup.

Figure 2:
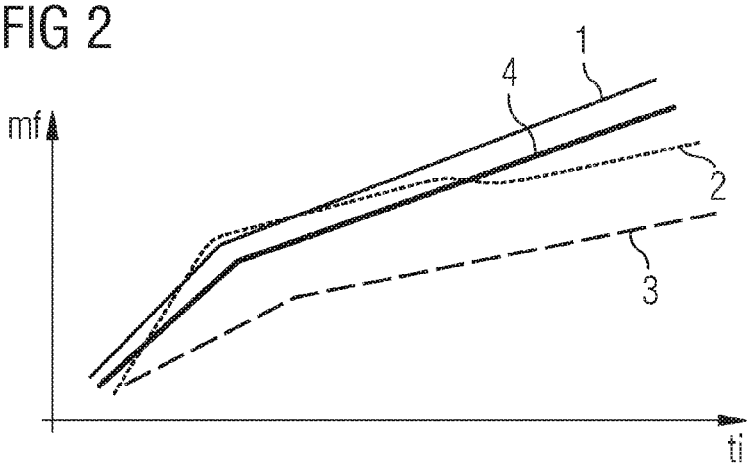
FIG. 2 a diagram in which the determination of the average ti characteristic field for constant injection pressure is shown.

To take account of injector-individual differences which are caused by manufacturing deviations, the IIC correction method is performed. In such cases the ti characteristic fields are measured for the injectors with mass flow technology and an average ti characteristic field is calculated. FIG. 2 shows corresponding characteristic fields 1, 2 and 3 for an injector 1, an injector 2 and an injector n as well as a computed average ti characteristic field 4.

Figure 3:
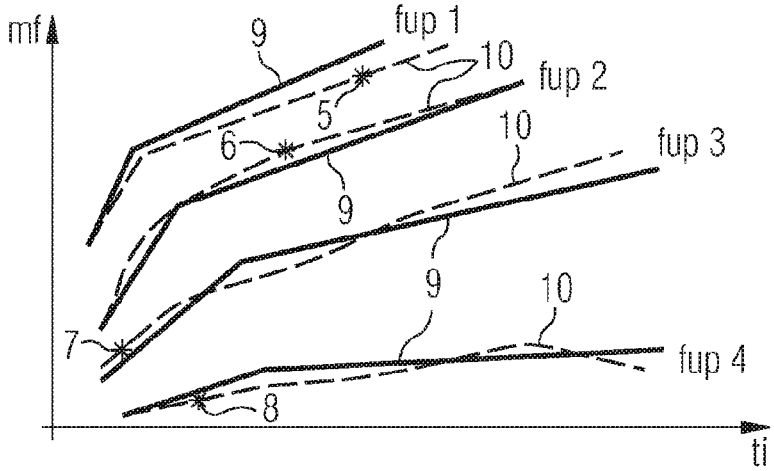
FIG. 3 a diagram which shows the IIC characteristic field determination for an injector.

The ti characteristic field deviations of subsequently measured injectors in relation to the average ti characteristic field 4 are then measured at a few measuring points and extrapolated on the basis of statistical methods for the entire ti characteristic field. FIG. 3 shows the average ti characteristic fields 9 for different fuel pressures fup 1, fup 2, fup 3 and fup 4 as well as for measuring points 5, 6, 7 and 8 and the injector-individual ti characteristic fields computed using the IIC method. To obtain the four measuring points, the corresponding measurements are carried out on the injector test bed. The corresponding measuring points 5, 6, 7 and 8 correspond to a fuel mass of 4 mg at 300 bar, of 15 mg at 700 bar, of 3 mg at 1000 bar and of 40 mg at 1600 bar. The injector-individual ti characteristic fields 10 will be determined or stored for motor vehicle operation.

Figure 4:
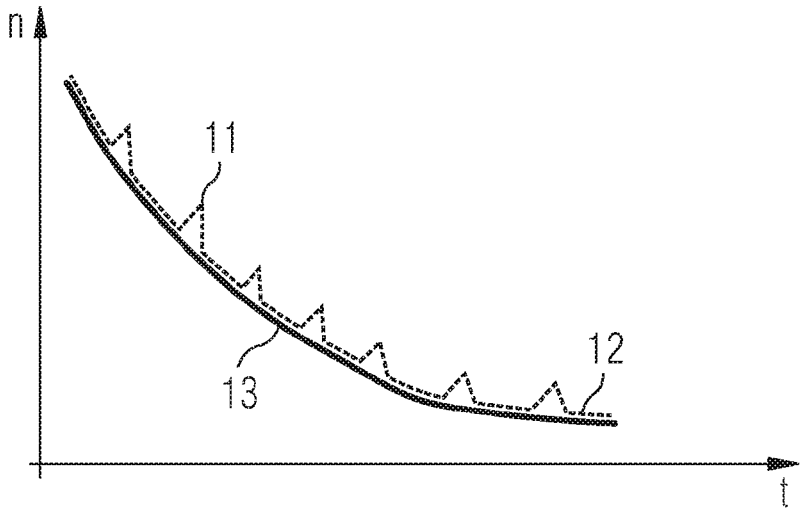
FIG. 4 a diagram in which the functions of the MFMA method are shown.

FIG. 4 shows, in a t(time)-n(engine speed) diagram, the way in which the MFMA method functions. With this method, in push phases in which no injections normally take place, small injections are carried out at a cylinder and the associated mass flow is computed on the basis of models from the change in the engine speed (n). The correction variables are stored injector-individually for the tested minimum mass flows in characteristic fields. FIG. 4 shows the change in speed in the push phase without MFMA at 13. The change in speed as a result of an injection as a measure for the injected mass flows is shown at 11. At 12 the change in speed in the push phase with MFMA is shown.

Figure 5:
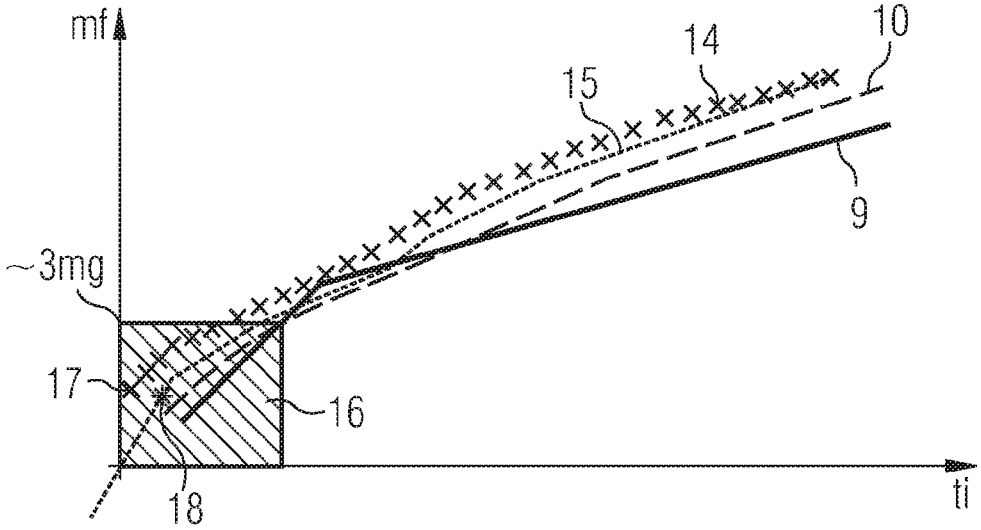
FIG. 5 a diagram to illustrate the method according to various embodiments.

In the method according to various embodiments (combination of the IIC method and the MFMA method) the IIC measurement and calculation of the deviations over the entire characteristic field continue to be undertaken before the vehicle goes on the road (in the manufacturing phase), as shown in FIGS. 2 and 3. This compensates for the injector-individual deviations when the vehicle is put into service. Furthermore the MFMA function is carried out during the entire operating life of the motor vehicle in the minimum mass flow range, as shown in FIG. 4. The MFMA measurements undertaken are now used as retrospective measurement points for the IIC function and by means of statistical methods deviations are then calculated for the complete ti characteristic field and stored injector-individually in corresponding characteristic fields. This is shown in the ti-mf diagram of FIG. 5. The average ti characteristic field that was obtained from the IIC method is shown by 9. The injector-individual ti characteristic field after IIC measurement is shown by 10 which is based on the four measurement points mentioned above. The number 16 indicates the smallest mass flow range (~3 mg) used for MFMA measurement. It is assumed that two MFMA measurements are used as retrospective measurement points for the IIC function, with this being shown as MFMA measurement point 1 at 18 and as MFMA measurement point 2 at 17. The newly-calculated injector-individual ti characteristic fields determined on the basis of these measurement points from IIC and MFMA measurement point 1 and 2 are labeled 15 and 14. These characteristic fields obtained from the combination of IIC and MFMA take account of both manufacturing deviations and also ageing and wear on the components during their lifetime and are used for determining or adapting the injection time.

What is claimed is:

1. A method for determining injection times for a plurality of injectors in a motor vehicle, comprising:

prior to the vehicle going on the road:

performing testing to generate complete characteristic fields for at least one of the injectors, each complete characteristic field defining an injection time-mass flow relationship for a complete range of mass flows for the at least one injector;

adapting the complete characteristic fields using an injector individual correction (IIC) method to generate IIC-adapted complete characteristic fields for the at least one injector; and storing the IIC-adapted complete characteristic fields in a memory of the motor vehicle; and while the vehicle is on the road:

performing minimum fuel mass adaption (MFMA) measurements according to an MFMA method to determine MFMA-measuring points, the MFMA measurements covering only a low-mass-flow subset of the complete range of mass flows;

comparing the determined MFMA measuring points in the low-mass-flow subset of mass flows to respective points of the stored IIC-adapted complete characteristic fields for at least on injector;

based on the comparisons, adjusting the stored IIC-adapted complete characteristic fields and storing the adjusted complete characteristic fields in the vehicle memory; and determining injection times based on the stored adjusted complete characteristic fields.

2. The method according to claim 1, wherein, in the IIC method, the characteristic fields are measured for individual injectors with mass flow measurement technology and an average characteristic field for the plurality of injectors is computed and adapted to generate IIC-adapted average complete characteristic fields for the plurality of injectors, and wherein the determined MFMA measuring points in the low-mass-flow subset of mass flows are compared to respective points of the stored IIC-adapted average complete characteristic fields for the plurality of injectors.

3. The method according to claim 2, wherein the characteristic field deviations of an injector from the average characteristic field are measured at a few measuring points and extrapolated for a complete characteristic field.

4. The method according to claim 1, wherein the IIC method is carried out on an injector test bed.

5. The method according to claim 1, wherein, in the MFMA method, associated mass flows are determined and used as retrospective measurement points for the IIC method.

6. The method according to claim 5, wherein, in the MFMA method, small injections are carried out in push mode and the associated mass flow is calculated from changes in the engine speed resulting from the small injections.

7. The method according to claim 1, wherein the MFMA method is carried out during the entire operating life of the motor vehicle.

8. A method for determining injection times for a plurality of injectors in a motor vehicle, comprising:

prior to driving of the vehicle:

performing testing to generate complete injection characteristic fields for at least one of the injectors, each complete characteristic field defining an injection time-mass flow relationship for a complete range of mass flows;

adapting the complete injection characteristic fields using an injector individual correction (IIC) method to generate IIC-adapted complete injection characteristic fields for the at least one injector; and storing the IIC-adapted complete injection characteristic fields in a memory of the motor vehicle; and while the vehicle is driving:

performing minimum fuel mass adaption (MFMA) measurements according to an MFMA method to determine MFMA-measuring points, the MFMA measurements covering only a low-mass-flow subset of the complete range of mass flows;

comparing the determined MFMA measuring points in the low-mass-flow subset of mass flows to respective points of the stored IIC-adapted complete injection characteristic fields for the at least one injector;

based on the comparisons, adjusting the stored IIC-adapted complete injection characteristic fields and storing the adjusted complete characteristic fields in the vehicle memory; and determining injection times based on the stored adjusted complete injection characteristic fields.

9. The method according to claim 8, wherein, in the IIC method, the characteristic fields are measured for individual injectors with mass flow measurement technology and an average characteristic field for the plurality of injectors is computed and adapted to generate IIC-adapted average complete characteristic fields for the plurality of injectors, and wherein the determined MFMA measuring points in the low-mass-flow subset of mass flows are compared to respective points of the stored IIC-adapted average complete characteristic fields for the plurality of injectors.

10. The method according to claim 9, wherein the injection characteristic field deviations of an injector from the average characteristic field are measured at a few measuring points and extrapolated for a complete characteristic field.

11. The method according to claim 8, wherein the IIC method is carried out on an injector test bed.

12. The method according to claim 8, wherein, in the MFMA method, associated mass flows are determined and used as retrospective measurement points for the IIC method.

13. The method according to claim 12, wherein, in the MFMA method, small injections are carried out in push mode and the associated mass flow is calculated from changes in the engine speed resulting from the small injections.

14. The method according to claim 12, wherein the MFMA method is carried out during the entire operating life of the motor vehicle.

* * * * *